US007207518B2

(12) United States Patent
Alculumbre et al.

(10) Patent No.: US 7,207,518 B2
(45) Date of Patent: Apr. 24, 2007

(54) CARTRIDGE WITH FIN DEPLOYMENT MECHANISM

(75) Inventors: Michael Alculumbre, London (GB); Fred Sharp, London (GB)

(73) Assignee: Olympic Technologies Limited (GI)

( * ) Notice: Subject to any disclaimer, the term of this patent is extended or adjusted under 35 U.S.C. 154(b) by 0 days.

(21) Appl. No.: 10/477,155

(22) PCT Filed: Apr. 8, 2002

(86) PCT No.: PCT/GB02/01655

§ 371 (c)(1),
(2), (4) Date: May 26, 2004

(87) PCT Pub. No.: WO02/090870

PCT Pub. Date: Nov. 14, 2002

(65) Prior Publication Data

US 2004/0217227 A1 Nov. 4, 2004

(30) Foreign Application Priority Data

May 8, 2001 (GB) ..... 0111171.5

(51) Int. Cl.
*F42C 15/24* (2006.01)

(52) U.S. Cl. ..... 244/3.29

(58) Field of Classification Search ..... 244/3.21, 244/3.24, 3.25, 3.26, 3.27, 3.29; 102/379, 102/385, 396, 439; 446/37, 38, 44, 45
See application file for complete search history.

(56) References Cited

U.S. PATENT DOCUMENTS 1,214,253 A * 1/1917 Aasen ..... 102/230
2,459,357 A * 1/1949 Bell ..... 102/385
2,793,591 A * 5/1957 Jasse ..... 244/3.29
2,858,765 A * 11/1958 Startzell ..... 244/3.29
2,923,241 A * 2/1960 House ..... 244/3.29
2,924,175 A * 2/1960 Jasse ..... 244/3.29
2,977,880 A * 4/1961 Kershner ..... 244/3.29
3,347,491 A * 10/1967 Auguste et al. ..... 244/3.27
3,580,529 A * 5/1971 Suter ..... 244/3.29
3,853,288 A * 12/1974 Bode ..... 244/3.29
3,880,383 A * 4/1975 Voss et al. ..... 244/3.27
4,165,847 A * 8/1979 Detalle ..... 244/3.29
4,232,843 A * 11/1980 Clark et al. ..... 244/3.29
4,296,895 A * 10/1981 Pazmany ..... 244/3.29
4,526,105 A * 7/1985 Herren, Jr. ..... 102/498

(Continued)

FOREIGN PATENT DOCUMENTS

EP 0 363 079 * 4/1990

(Continued)

*Primary Examiner*—Teri Pham Luu
*Assistant Examiner*—Stephen Holzen
(74) *Attorney, Agent, or Firm*—Lawrence E. Laubscher, Jr.

(57) ABSTRACT

A projectile for a weapon comprises an axially movable firing pin, an initiator actuable when impinged by the firing pin, a plurality of external peripheral fins movable from a radially inward position to a radially outward position when the projectile leaves the weapon, fin engaging means for moving each fin from the radially inward position to the radially outward position and for maintaining each fin in the radially outward position, and internal actuating means for actuating the fin engaging means to engage and thereby move the fins to deploy from the radially inward to the radially outward position as the projectile leaves the weapon.

16 Claims, 6 Drawing Sheets

U.S. PATENT DOCUMENTS

| | | | | | |
|---|---|---|---|---|---|
| 4,600,167 | A | * | 7/1986 | Kastenhuber et al. | 244/3.28 |
| 4,869,442 | A | * | 9/1989 | Miller | 244/3.28 |
| 5,046,424 | A | * | 9/1991 | Skowasch et al. | 102/226 |
| 5,048,772 | A | * | 9/1991 | Wisshaupt | 244/3.23 |
| 5,072,891 | A | * | 12/1991 | Cavalleri et al. | 244/3.21 |
| 5,189,250 | A | * | 2/1993 | Shaphyr | 102/439 |
| 5,467,940 | A | * | 11/1995 | Steuer | 244/3.11 |
| 5,950,963 | A | * | 9/1999 | Speicher et al. | 244/3.21 |
| 6,067,909 | A | * | 5/2000 | Knoster, Jr. | 102/517 |
| 6,250,584 | B1 | * | 6/2001 | Hsu et al. | 244/3.24 |
| 6,352,217 | B1 | * | 3/2002 | Hsu et al. | 244/3.24 |
| 6,502,516 | B1 | * | 1/2003 | Kinchin | 102/517 |
| 6,604,467 | B2 | * | 8/2003 | Alculumbre et al. | 102/249 |
| 6,739,548 | B1 | * | 5/2004 | Bittle et al. | 244/3.29 |
| 6,745,978 | B1 | * | 6/2004 | King et al. | 244/3.28 |
| 6,796,525 | B2 | * | 9/2004 | Johnsson et al. | 244/3.28 |
| 6,899,034 | B1 | * | 5/2005 | Glover et al. | 102/457 |
| 6,905,093 | B2 | * | 6/2005 | Dryer et al. | 244/3.28 |
| 2004/0011919 | A1 | * | 1/2004 | Johnsson et al. | 244/3.29 |

FOREIGN PATENT DOCUMENTS

| | | | | |
|---|---|---|---|---|
| EP | 0363079 | A2 | | 4/1990 |
| GB | WO 99/51934 | | * | 10/1999 |
| WO | WO99/51934 | | * | 10/1999 |
| WO | WO 02/18867 | A1 | | 3/2002 |

* cited by examiner

CARTRIDGE WITH FIN DEPLOYMENT MECHANISM

The present invention relates to a projectile for a weapon, in particular a projectile having an improved fin deployment mechanism.

Projectiles having stabilising fins are well known in the art. When the projectile leaves the barrel of the weapon the fins deploy from a radially inward position to a radially outward position, to provide stability of the projectile during flight.

Various mechanisms by which projectile fins are deployed are known. For example, fins may be deployed and maintained in a radially outward position by being biassed by springs. When the projectile is within the barrel of a weapon the fins are restrained by the internal barrel wall or a cartridge sleeve in a radially inward position, and when the projectile leaves the barrel the fins are no longer restrained and the springs urge the fins into the radially outward position. However, spring biassed mechanisms have a number of drawbacks. Firstly, they can create manufacturing difficulties, in particular for small arms projectiles where fitting the springs may involve prohibitively slow or costly manufacturing equipment and processes, or may even necessitate manual fitting, particularly for small arms projectiles. In addition, springs can also lose their initial resilience if constrained in a compressed state over a significant period of time, for example during storage of a projectile having spring biassed fins after manufacture. This can result in a relatively short shelf-life for the projectile if the risk of fin deployment difficulties due to spring failure is to be minimised. Furthermore, springs are conventionally made of thin metal wire, which can corrode over time, resulting in an increased risk of spring failure.

The present invention can provide a projectile for a weapon in which the fins are deployed and maintained in a radially outward position without using springs, and hence can overcome the aforementioned disadvantages of spring biassed fin deployment mechanisms, for example through improved manufacturing efficiency, and reduced risk of fin deployment failure after storage.

According to the present invention there is provided a projectile for a weapon, which projectile comprises:

an axially movable firing pin;

an initiator actuable when impinged by the firing pin;

a plurality of external peripheral fins movable from a radially inward position to a radially outward position when the projectile leaves the weapon;

fin engaging means for moving each fin from the radially inward position to the radially outward position and for maintaining each fin in the radially outward position; and internal actuating means for actuating the fin engaging means to engage and thereby move the fins to deploy from the radially inward to the radially outward position as the projectile leaves the weapon.

The actuating means is positioned internal to the casing, and actuates the fin engaging means following firing of the projectile from the weapon. This is conveniently achieved by axial movement of the actuating means towards the fin engaging means in response to the projectile leaving the barrel of a weapon. When the projectile is fired from the barrel of a weapon, the actuating means moves axially away from the initiator, and into engagement with the fin engaging means to thereby actuate the latter. The actuating means is preferably biassed towards the fin engaging means. More preferably, the actuating means is urged by a spring, even more preferably a single central compression spring, towards the fin engaging means.

A convenient means by which the actuating means can engage the fin engaging means is via a cam surface, for example a cam surface in the form of a frusto-conical portion of the actuating means which narrows towards the fin engaging means. Thus, as the frusto-conical cam surface moves axially towards and engages the fin engaging means, it exerts radially outward pressure thereon, which radially outward pressure is transmitted via the fin engaging means to the fins.

The actuating means may, for example, be in the form of a biassed or unbiassed axially moveable sheath or tube internal to the casing, but preferably comprises the firing pin, and more preferably comprises the firing pin biassed towards the fin engaging means. Such an arrangement simplifies the design and manufacture of the projectile by helping to minimise the number of component parts. Thus, the firing pin can serve the dual purpose of impinging on the initiator to initiate an explosive charge and thereby detonate the warhead, and of actuating the fin engaging means so as to deploy the fins in the radially outward position.

The fin engaging means may take any form which can apply radially outward pressure to the fins. The fin engaging means preferably comprises a fin engaging pin per fin, each pin being radially moveable relative to the actuating means, and being disposed between the fin and the actuating means. Each pin is preferably fashioned to have a hemispherical inner end for engagement with the actuating means, and a conical outer end for engagement with a fin. Thus, in use the inner end of each pin engages the actuating means, and the outer end of each pin engages a fin. Axial movement of the actuating means causes radially outward movement of each pin, which in turn causes each fin engaged thereby to move radially outward. The precise angle of disposal of the pins relative to the longitudinal/rotational axis of the projectile will of course depend upon the precise mechanism of the engagement between the actuating means and the fin engaging means, to maximise mechanical advantage of the mechanism, as will be apparent to those skilled in the art.

The fin engaging means preferably also releasably restrains the firing pin in a safety position until actuation, and when actuated allows the firing pin to move into an armed position. The fin engaging means can thus provide a safety system for the projectile, whereby the firing pin is restrained in a safety position in which it cannot impinge the initiator until the fin engaging means is actuated by the actuating means, achieved on firing when the projectile leaves the barrel of a weapon.

In a preferred embodiment, as described above, the fin engaging means comprises pins disposed between the actuating means and the fins. For ease of assembly, the projectile preferably further comprises means for moving the fins from the radially outward position to a position which provides improved access to the fin engaging means over the access provided to the fin engaging means when the fins are in the radially outward position. The means for moving the fins conveniently comprises a hinge along which the fins are axially movable from a first position to a second position, whereby radial movement of the fins in the second position is less restricted than radial movement of the fins in the first position.

The projectile of the present invention preferably also comprises a casing, which casing has an inner sleeve therewithin adjacent the inner wall thereof for guiding movement of the actuating means and fin engaging means. In a preferred embodiment, the inner sleeve comprises longitudinal slots within which said fin engaging pins are disposed. The inner sleeve may further provide means for fixing the spring which biasses the firing pin to the casing, as described hereinabove.

The projectile of the present invention preferably also comprises a firing pin release means within the casing, which release means is axially moveable relative to the casing away from the initiator, and helps retain the firing pin in the safety position, i.e. prevents axial movement of the firing pin towards the fin engaging means prior to firing of the projectile from a weapon. On firing the projectile in the barrel of a weapon, the initial acceleration of the projectile causes the release means to move axially within the casing away from the initiator, thereby disengaging from the firing pin so it no longer prevents axial movement of the firing pin, and thereby does not prevent the firing pin from moving from the safety position to the armed position.

The projectile of the present invention preferable also comprises further safety means for helping to retain the firing pin in the safety position prior to firing the projectile from a weapon, by preventing axial movement of the firing pin away from the initiator. In preferred embodiments of the present invention, the safety means comprises a crushable support element and/or a frangible safety pin.

The crushable support element is disposed towards the rear of the casing, i.e. axially opposite the warhead, and supports the firing pin and release means (when present) prior to firing the projectile from a weapon, thereby preventing axial movement of the firing pin and release means (when present). However, on firing the projectile from a weapon, the forces of acceleration cause the firing pin and/or release means (when present) to move axially towards the support element, to thereby crush the support element and position the firing pin in the armed position, or freeing space for it to do so. The crushable support element may conveniently comprise a crushable washer. The forces of acceleration experienced by a projectile on being fired from a weapon will vary according to the particular projectile and weapon in question; however, these forces will typically range from 10,000 to 40,000 g and beyond (wherein "g" represents acceleration due to gravity), and the crushable support element, for example a crushable washer, should be engineered to withstand forces of acceleration accordingly.

The purpose of the frangible safety pin is also to prevent axial movement of the firing pin from the safety position to the armed position prior to firing of the projectile from the weapon, and operates on the same principles as the crushable support element. The safety pin thus engages the firing pin or release means (when present) prior to firing, but is broken by axial movement of the firing pin or release means (when present) under the forces of acceleration on firing the projectile from a weapon. In a preferred embodiment, the safety pin is disposed within the casing, and has a frangible inner portion which extends inside the casing and engages and holds the release means such that the firing pin is held in the safety position. On firing the projectile from a weapon, the forces of acceleration cause the release means to move axially away from the initiator within the casing, to thus break the inner portion of the safety pin, and thereby no longer prevent the firing pin from moving axially within the casing from the safety position to the armed position.

The initiator of the projectile of the present invention may be any conventional initiator which when impinged by the firing pin generates an explosive charge which can initiate detonation of the warhead. Such initiators are well known to those skilled in the art. A particularly preferred initiator for use in the projectile of the present invention is disclosed in WO 99/51934, wherein the initiator is biassed towards an armed position, but prior to firing is held in a safety position by the firing pin. On firing, the firing pin moves axially away from the initiator, the initiator is urged from the safety to an armed position, and is available to be impinged by the firing pin on impact with a target.

The projectile of the present invention preferably further comprises a back plate fitted to the rear of the casing, i.e. longitudinally opposite the warhead. The backplate is conveniently discoidal and may be fitted to the casing by a screw fitting. The back plate provides a shield against fin damage within the barrel of a weapon on firing of the projectile. Such damage may occur, for example, due to distortion of a cartridge sleeve surrounding the projectile within the barrel, and may result in unreliable firing.

There is in principle no restriction as to the size of the projectile of the present invention. For example, the projectile may be a small arms projectile, a mortar projectile, an artillery projectile, and the like. However, the projectile of the present invention is particularly suitable for use with small arms.

Thus, in use the projectile of the present invention is placed within the barrel of a weapon for firing. Firing the projectile causes axial movement of the actuating means within the casing, thus actuating the fin engaging means by exerting a radially outward force thereon. This radially outward force is transmitted via the fin engaging means to the fins, thus causing the fins to move from a radially inward position to a radially outward position.

The invention will now be described, by way of illustration only, with reference to the accompanying drawings in which.

FIGS. 6*a* to 6*h* are isometric views of the rear section of a projectile according to the present invention showing a preferred assembly sequence of the fin engaging means.

Figure 1:
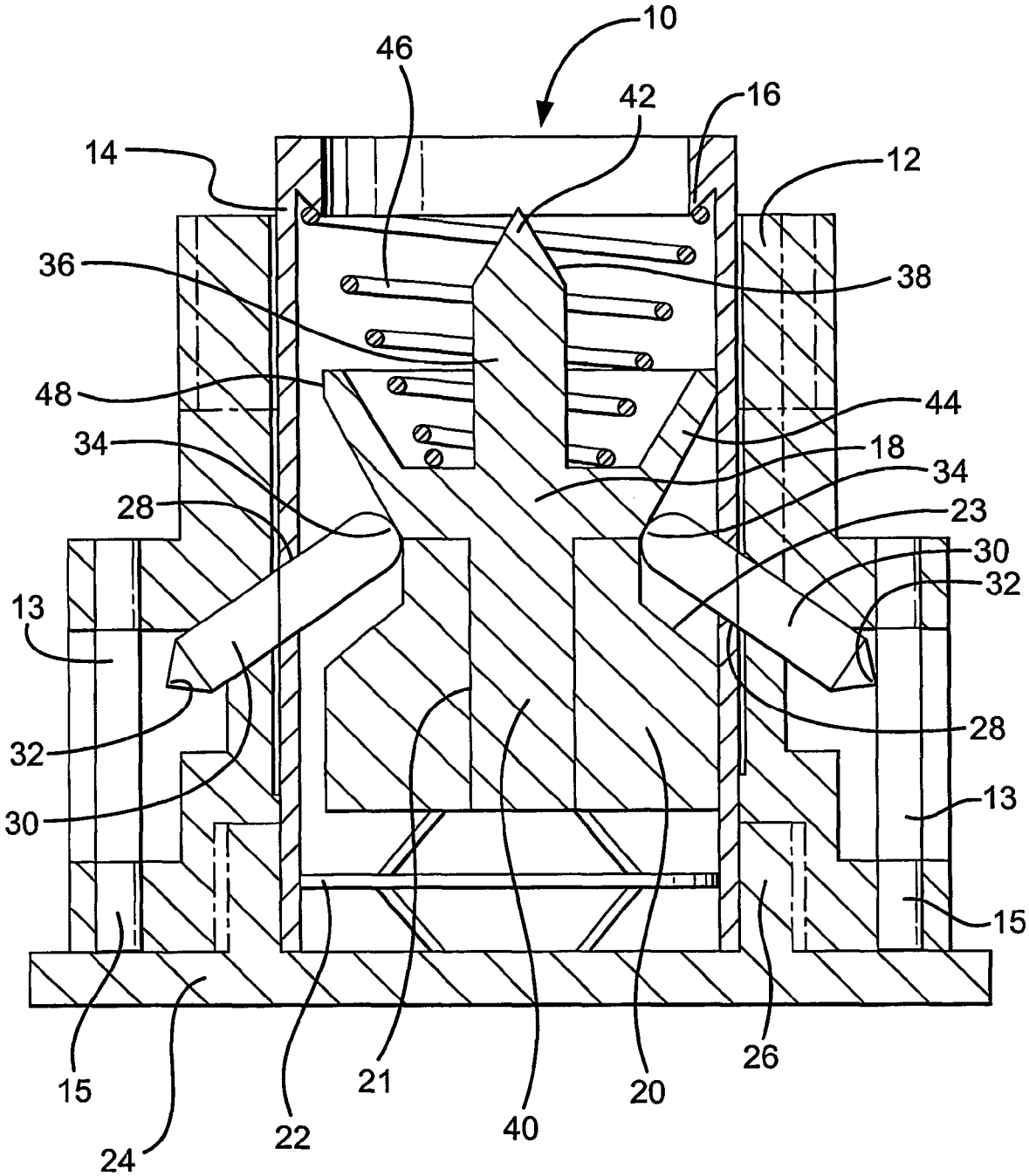
FIG. 1 is a vertical cross-section view of the rear section of a projectile prior to firing the projectile from a weapon.
Figure 2:
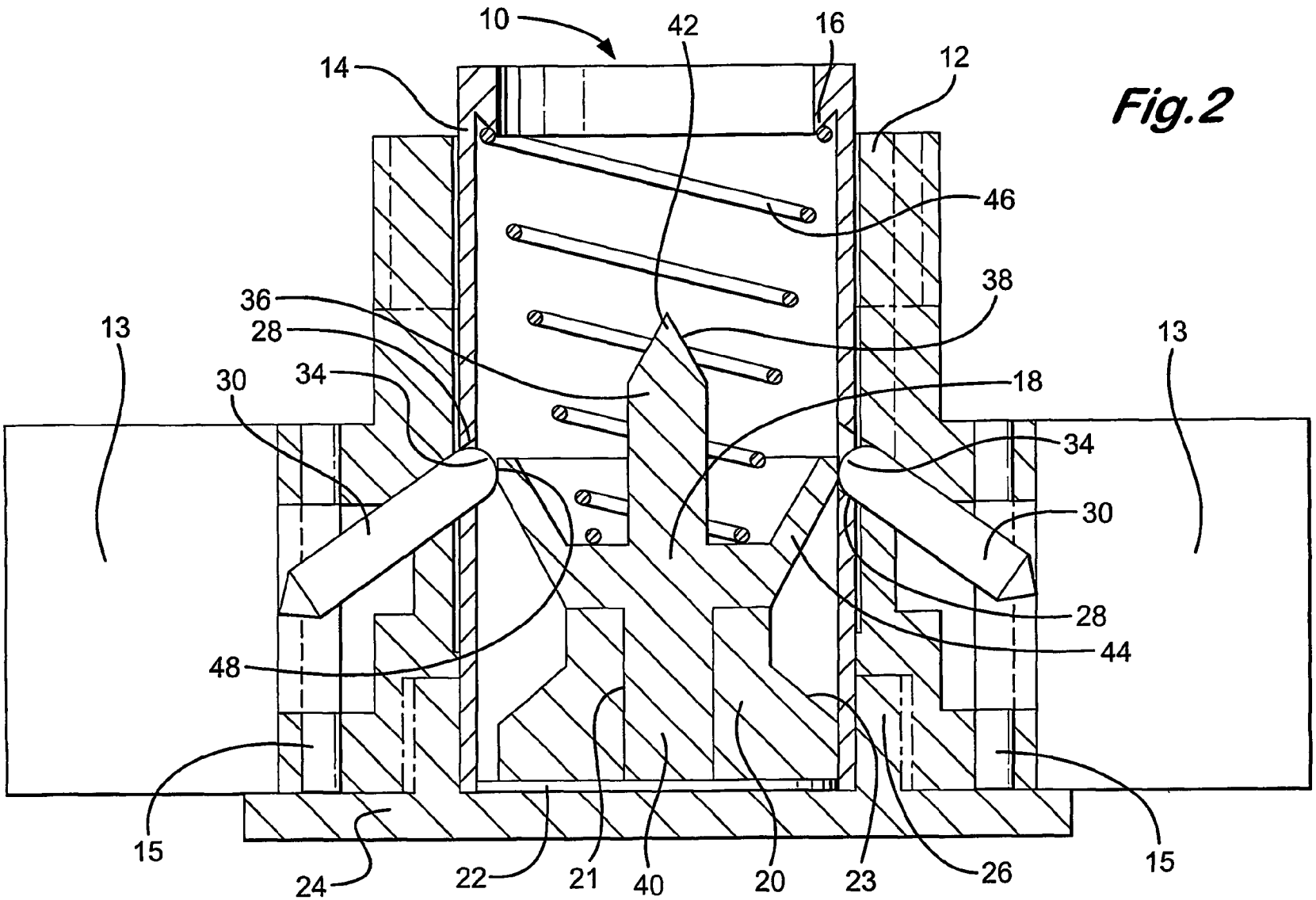
FIG. 2 shows the same view as FIG. 1 showing the projectile after leaving the barrel of a weapon.

N.B. In FIGS. 1 and 2 the initiator and warhead have been omitted for clarity.

With reference to FIG. 1, the rear end of a projectile (10) is shown having a longitudinal casing (12). Externally mounted to the rearward end of the casing are four fins (13), two of which are shown in FIGS. 1 and 2, via hinges (15). The four fins (13) are disposed equidistantly around the circumference of the casing (12). In FIG. 1 the fins (13) are shown in the radially inward position.

Disposed within the casing adjacent the inner wall thereof is an inner sleeve (14) which extends the length of the casing (12). The inner sleeve (14) has an inwardly projecting flange (16) at the forward end thereof. Within the inner sleeve are disposed a firing pin (18), firing pin release means (20), and a crushable support member (22) in the form of a crushable washer. The firing pin (18) comprises a shaft (36) aligned along the axis of the casing, which shaft (36) has forward (38) and rearward (40) projecting portions. The forward portion (38) has a conical tip (42) which in use impinges on the initiator (not shown) on impact of the projectile with a target. The firing pin (18) further comprises a frustoconical sleeve (44), which tapers outwardly towards the forward portion of the casing (12). The forwardmost portion of the frustoconical sleeve has a surface (48) which is substantially parallel to the axis of the casing (12). The firing pin (18) is axially rearwardly biassed by a spring (46) which at one end engages the flange (16) and at the other engages and is fixed relative to the casing by the inner surface of sleeve (44).

A backplate (24) is attached to the rear end of the casing (12) by threaded flange (26), which backplate (26) supports the support member (22).

The release means (20) rests on the support member (22) and has a central bore (21) therethrough within which the rearward portion (40) of the shaft (36) of the firing pin (18) rests, thereby supporting the firing pin (18). The sides (23) of the release means (20) taper towards the forward end of the casing (12).

The inner sleeve (14) further includes longitudinal guide slots (28) within which are disposed fin engaging pins (30). One pin (30) is present per fin (13), i.e. four pins in total, although only two pins (30) are shown in FIGS. 1 and 2. The pins (30) have an outer conical end (32) and an inner hemispherical end (34). The outer end (32) of each pin engages a fin (13) adjacent the hinge (15) for greatest mechanical advantage, and the inner end (34) engages the outer surface of sleeve (44). Within, for example, a cartridge casing or the barrel of a weapon, the pins (30) are thus fixed in the radially inward position shown in FIG. 1 by the fins (13).

The casing (12) also comprises two safety pins (not shown) disposed therein, which project through corresponding holes (also not shown) in the casing (12) and inner sleeve (14). The safety pins (not shown) each have an inner portion which engages the release means (20). The safety pins (not shown) are disposed diametrically opposite each other and equidistantly between two fins, perpendicularly to the axis of the casing (12).

Figure 3:
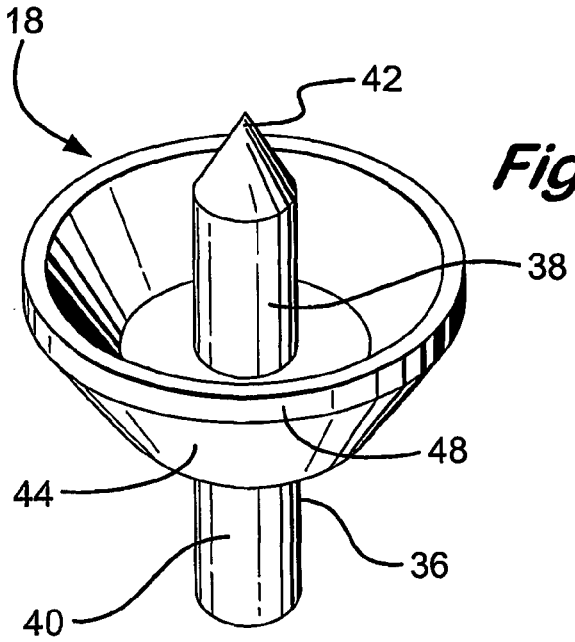
FIG. 3 is an isometric view of the firing pin shown in FIGS. 1 and 2.

Referring to FIG. 3, the firing pin (18) comprises a shaft (36) having forward (38) and rearward (40) projecting portions. The forward portion (38) has a conical tip (42) which in use impinges on the initiator (not shown) on impact of the projectile with a target. The firing pin (18) further comprises a frustoconical sleeve (44), which tapers outwardly towards the forward portion of the casing (12). The forwardmost portion of the frustoconical sleeve has a surface (48) which in use is substantially parallel to the axis of the casing (12).

Figure 4:
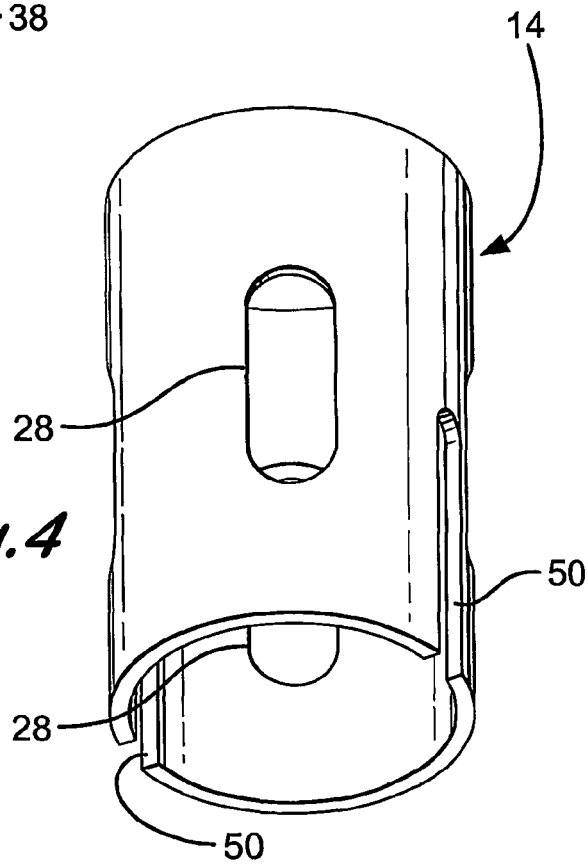
FIG. 4 is an isometric view of the inner sleeve shown in FIGS. 1 and 2.

Referring to FIG. 4, the inner sleeve (14) includes longitudinal guide slots (28) within which in use are disposed fin engaging pins (30). The inwardly projecting flange (16) is not shown in FIG. 4. The inner sleeve (14) further comprises further longitudinal slots (50) through which in use the safety pins (not shown) are disposed.

Figure 5:
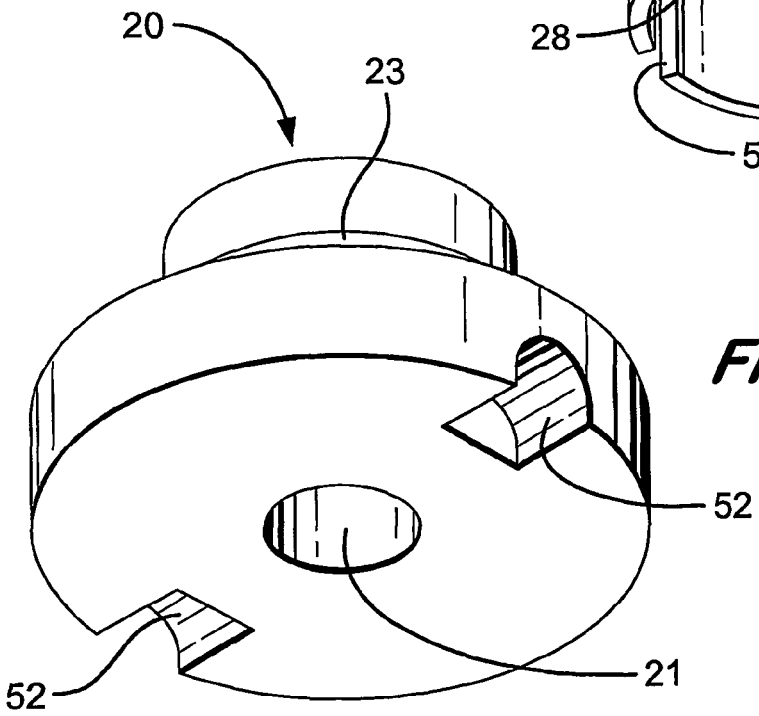
FIG. 5 is an isometric view of the firing pin release means shown in FIGS. 1 and 2.

Referring to FIG. 5, the release means (20) has a central bore (21) therethrough within which in use the rearward portion (40) of the shaft (36) of the firing pin (18) rests, thereby supporting the firing pin (18). The sides (23) of the release means (20) taper towards the forward end of the casing (12), to allow the pins (30) to engage the surface (44). The release means (20) further includes indents (52), by which in use the inner portions of the safety pins (not shown) engage the release means (20).

Thus, FIG. 1 shows the rear end of a projectile (10) prior to firing from a weapon. On firing from a weapon, the acceleration of the projectile within the barrel of the weapon forces the release means (20) axially towards the rear of the casing (12). The release means (20) thereby breaks the inner portion of the safety pins (not shown) and crushes the support member (22). The firing pin (18) remains in the position shown in FIG. 1 when the projectile is within the barrel since, although urged towards the release means (20) by spring (46), the fins (13) are restrained in the radially inward position shown in FIG. 1 by the inner wall of the barrel, which maintain the pins (30) in the radially inward position shown in FIG. 1, the inner ends (34) of which engage the outer surface of sleeve (44), thus maintaining the firing pin (18) in the FIG. 1 position. However, on leaving the barrel, the restraint of the inner wall of the barrel is removed, and the spring (46) urges the firing pin (18) axially from the safety position of FIG. 1 to the armed position shown in FIG. 2. Such axial movement of the firing pin (18) causes the pins (30) to move radially outward within guide slots (28) via the outer surface of the sleeve (44)and inner ends (34), and the outer ends (32) thus force the fins (13) radially outward. The firing pin (18) is held in the armed position shown in FIG. 2 by the spring (46). The fins (13) cannot return to the radially inward position because the pins (30) are fixed in the radially outward position shown in FIG. 2 between the fins (13) and the forwardmost surface (48) of the sleeve (44). On reaching a target, the deceleration of the projectile provides sufficient axial force in the forward direction that the firing pin (18) can overcome the bias of the spring (46) and can impinge the initiator (not shown) tho thereby detonate the warhead.

Figure 6A:
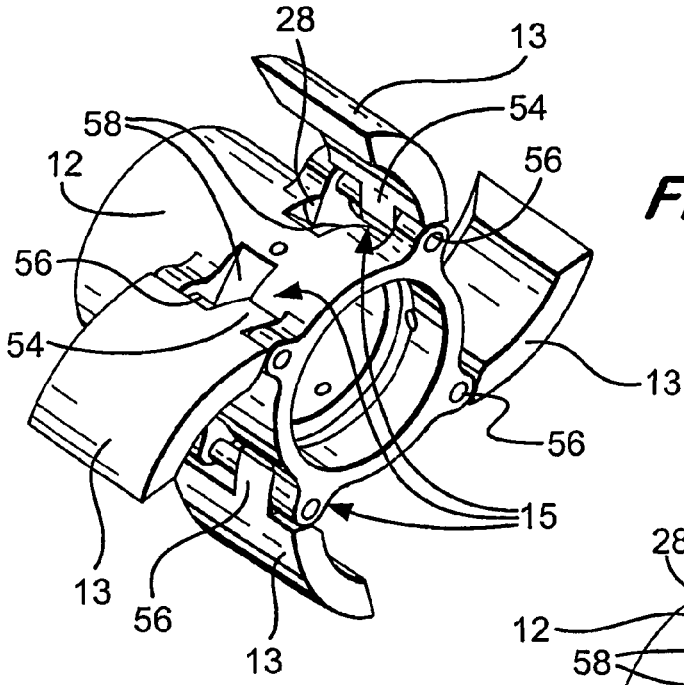

With reference to FIGS. 6*a* to 6*h*, the fin engaging pins (30) may be inserted as follows. FIG. 6*a* shows the rear section of a projectile prior to insertion of pins (30). The fins (13) are pivotally mounted to the casing (12) by hinges (15). Each fin (13) has a hinge portion (54) adjacent the casing (12) through which a hinge pin (56) passes. The hinge pins (56) are mounted to the casing (12) parallel to its axis. The hinge portions (54) are substantially narrower than the length of the hinge pins (56) to allow the fins (13) to be axially slidable along the hinge pins (56). In FIG. 6*a* the hinge portions (54) are in an axially rearward position on the hinge pins (56). The hinge portions (54) extend from the fins (13) beyond the hinge pins (56) towards the casing (12), so that radial rotation of the fins (13) about the hinges (15) is restricted when the fins are in the axially rearward position, i.e. as during flight of the projectile, due to stopping of the hinge portions (54) by the casing (12). The casing (12) comprises indents (58) around its outer circumference aligned perpendicular to and beneath the hinge pins (56) in an axially forward position. Each indent (58) extends longitudinally along the casing (12) to an extent marginally greater than the width of each hinge portion (54).

Figure 6B:
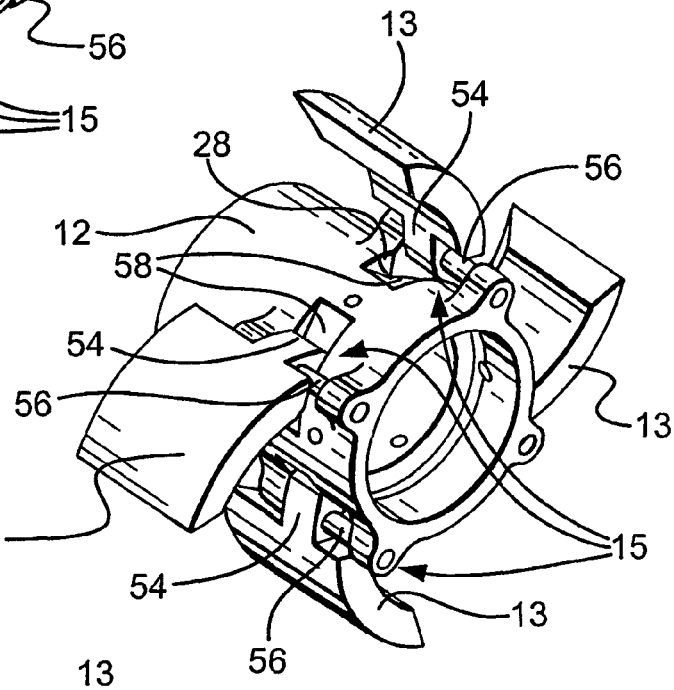
Figure 6C:
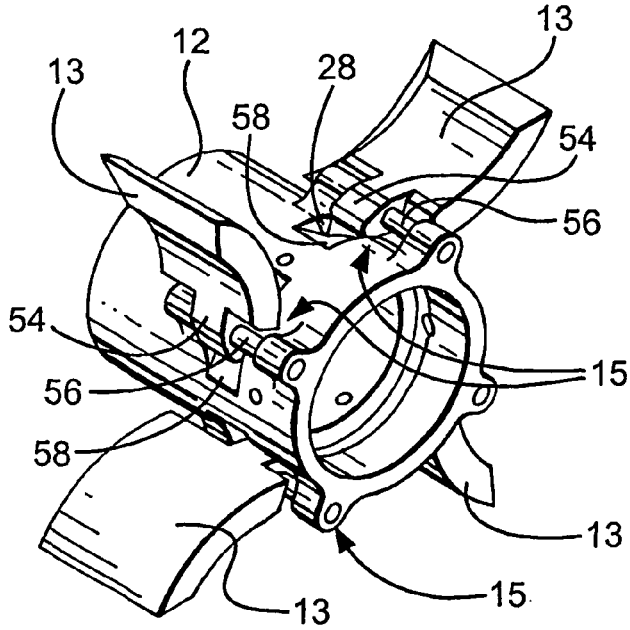
Figure 6D:
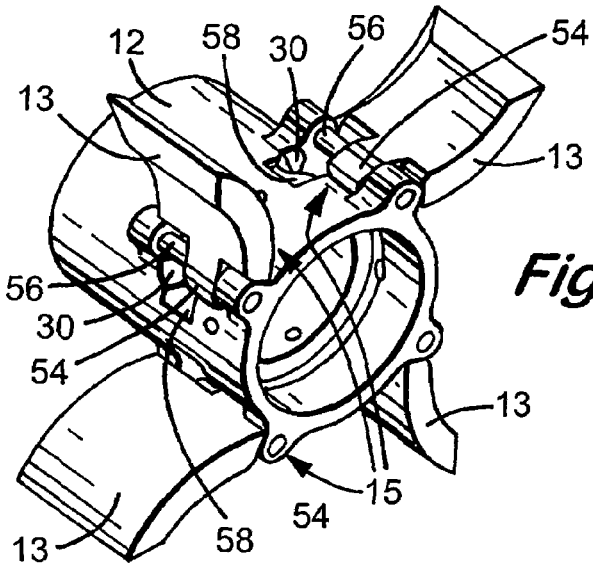
Figure 6E:
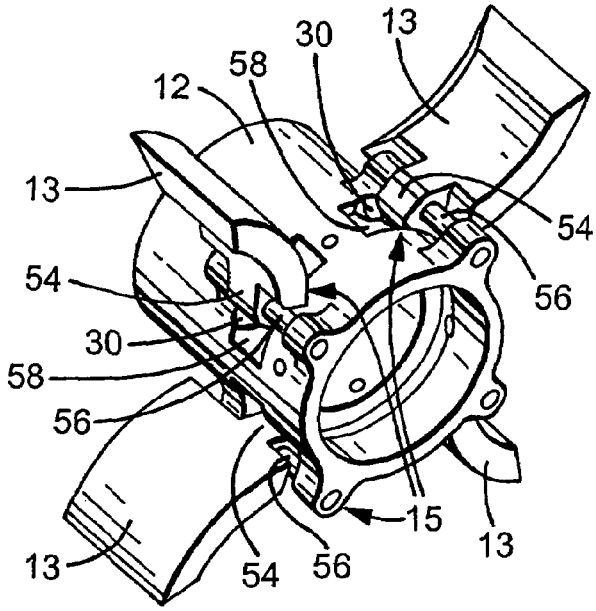
Figure 6F:
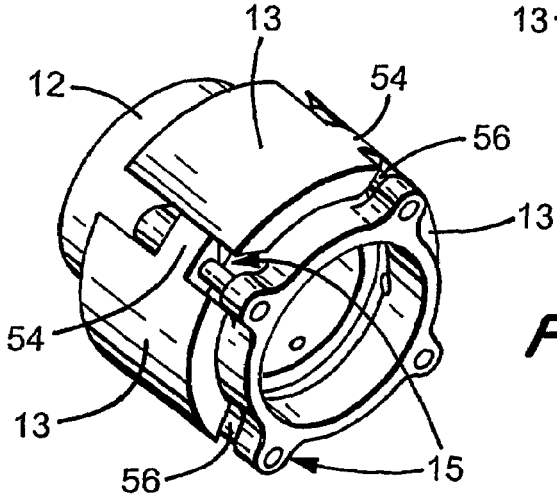
Figure 6G:
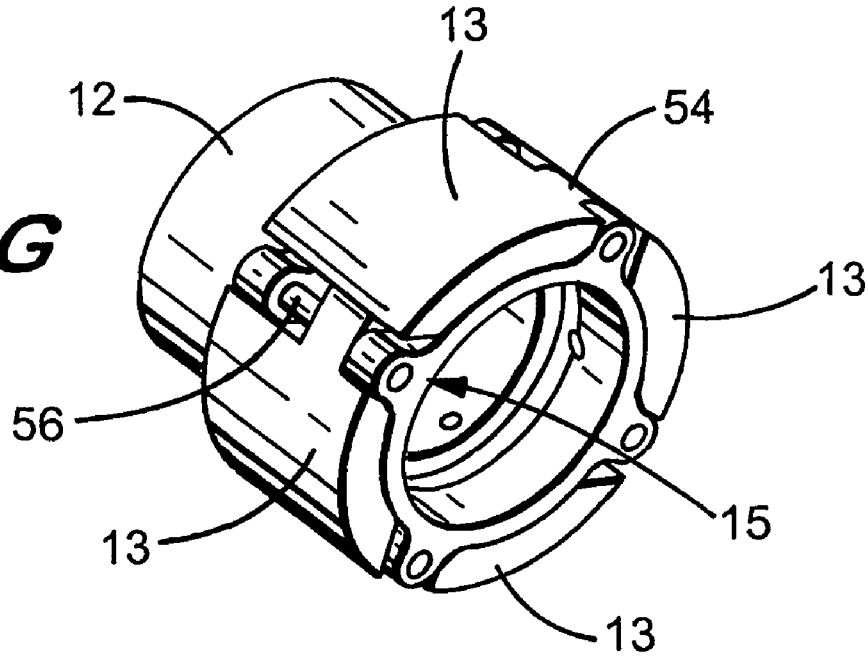
Figure 6H:
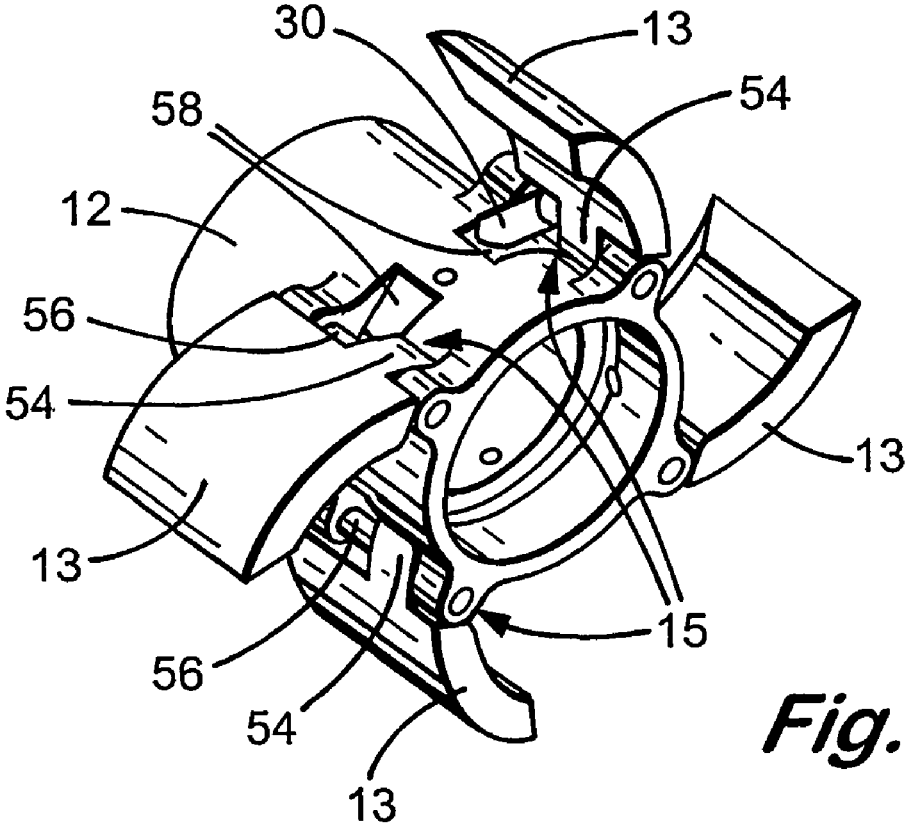

For insertion of the fin engaging pins (30), the fins (13) are moved axially forward along the hinge pins (56) to the position shown in FIG. 6*b*, i.e. such that each hinge portion (54) is in axial correspondence with an indent (58). In the axially forward position shown in FIG. 6*b*, the fins (13) may be rotated in direction A, the indents (58) allowing rotation of the fins (13) about the hinge pins (58) beyond the radially outward position shown in FIG. 6*a* to the position shown in FIG. 6*c*. The fins (13) are then moved axially rearwardly along the hinge pins (56) to the position shown in FIG. 6*d* to allow access to the guide slots (28). The fin engaging pins (30) are then inserted into the guide slots (28), as shown in FIG. 6*d*. Once the fin engaging pins (30) have been inserted in the guide slots (28), the fins (13) are returned to the axially forward position, as shown in FIG. 6*e*, and are rotated about the hinge pins (56) to the radially inward position shown in FIG. 6*f*. The fins (13) are then returned to the axially rearward position, whilst being maintained in the radially inward position, as shown in FIG. 6*g*. The fin engaging pins (30) are thus inserted, and are ready for actuation of the fins (13) from the radially inward position to the radially outward position, as described hereinabove. FIG. 6*h* shows the fin engaging pins (30) and fins (13) in the radially outward position following actuation.

It will be understood that the illustrated embodiment described herein shows an application of the invention in one form only for the purposes of illustration. In practice the invention may be applied to many different configurations the detailed embodiments being straightforward to those skilled in the art to implement.

The invention claimed is:

1. A projectile for a weapon, which projectile comprises:

a plurality of external peripheral fins movable from a radially inward position to a radially outward position when the projectile leaves the weapon;

a fin engaging pin per fin for engaging each fin to force it to move from the radially inward position to the radially outward position and for maintaining each fin in the radially outward position;

internal actuating means for actuating the fin engaging pins to engage and thereby move the fins to deploy from the radially inward to the radially outward position as the projectile leaves the weapon; and release means for preventing movement of said internal actuating means prior to firing the projectile and for releasing said internal actuating means in response to the acceleration of firing the projectile.

2. A projectile according to claim 1, wherein the actuating means actuates the fin engaging pins by axial movement of the actuating means towards the fin engaging pins in response to the projectile leaving the weapon.

3. A projectile according to claim 2, wherein the actuating means is biassed towards the fin engaging pins.

4. A projectile according to claim 1, wherein the actuating means comprises an axially movable firing pin.

5. A projectile according to claim 4, wherein the fin engaging pins releasably restrain the firing pin in a safety position until actuation of the fin engaging pins, and which when actuated allows the firing pin to move into an armed position.

6. A projectile according to claim 1, wherein each fin engaging pin is disposed between a fin and the actuating means.

7. A projectile according to claim 6, wherein each fin engaging pin has a hemispherical inner end for engagement with the actuating means, and a conical outer end for engagement with a fin.

8. A projectile according to claim 1, which further comprises means for disengaging the fins from their radially outward position to allow access to the fin engaging pins.

9. A projectile according to claim 1, which further comprises a casing, which casing has an inner sleeve therewithin adjacent the inner wall thereof for guiding movement of the actuating means and fin engaging means.

10. A projectile according to claim 9, wherein the inner sleeve includes longitudinal slots within which the fin engaging pins are disposed.

11. A projectile according to claim 9, wherein the inner sleeve provides means for fixing a means for biassing the actuating means to the casing.

12. A projectile according to claim 1, which further comprises a crushable support element on which the release means is supported, which release means is axially moveable towards the support element.

13. A projectile according to claim 1, which further comprises a back plate fitted to the casing.

14. A projectile according to claim 1, which further comprises means for moving the fins from the radially outward position to a position which provides improved access to the fin engaging pins over the access provided to the fin engaging pins when the fins are in the radially outward position.

15. A projectile according to claim 14, wherein the means for moving the fins comprises a hinge along which the fins are axially movable from a first position to a second position, whereby radial movement of the fins in the second position is less restricted than radial movement of the fins in the first position.

16. A projectile according to claim 1 which is a small arms projectile.

* * * * *